US010656583B2

(12) United States Patent
Goto et al.

(10) Patent No.: US 10,656,583 B2
(45) Date of Patent: May 19, 2020

(54) IMAGE FORMING SYSTEM

(71) Applicant: FUJI XEROX CO., LTD., Tokyo (JP)

(72) Inventors: Osamu Goto, Kanagawa (JP); Yoshiki Matsuzaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 79 days.

(21) Appl. No.: 15/963,984

(22) Filed: Apr. 26, 2018

(65) Prior Publication Data

US 2019/0196380 A1 Jun. 27, 2019

(30) Foreign Application Priority Data

Dec. 25, 2017 (JP) ..... 2017-247274

(51) Int. Cl.
*G03G 15/00* (2006.01)

(52) U.S. Cl.
CPC ..... *G03G 15/5062* (2013.01); *G03G 15/607* (2013.01); *G03G 2215/00021* (2013.01)

(58) Field of Classification Search
CPC ..... G03G 15/0121; G03G 15/5058; G03G 15/5062; G03G 15/6561; G03G 2215/00021; G03G 2215/0161
See application file for complete search history.

(56) References Cited

U.S. PATENT DOCUMENTS 8,073,349 B2 * 12/2011 Zaima ..... G03G 15/065 399/49
8,867,946 B2 10/2014 Sobue
2007/0263255 A1 * 11/2007 Johnson ..... G03G 15/5079 358/2.1
2011/0076045 A1 * 3/2011 Sobue ..... G03G 15/5062 399/81
2012/0224876 A1 * 9/2012 Nakayama ..... G03G 15/2039 399/69
2017/0111547 A1 * 4/2017 Otani ..... H04N 1/06

FOREIGN PATENT DOCUMENTS

JP 63030870 A * 2/1988
JP 2008-023791 2/2008
JP 2011069980 4/2011

* cited by examiner

*Primary Examiner* — Francis C Gray
(74) *Attorney, Agent, or Firm* — JCIPRNET

(57) ABSTRACT

An image forming system includes a first image forming apparatus and a second image forming apparatus. The first image forming apparatus includes an image forming unit that at least forms an image of a first color. The second image forming apparatus includes an image forming unit that forms an image of a second color different from a color of an image formed by the image forming unit of the first image forming apparatus, and also includes an image forming unit that forms an image of the first color. The first image forming apparatus and the second image forming apparatus use the first color to form positional-adjustment images for adjusting image formation positions between the first image forming apparatus and the second image forming apparatus.

9 Claims, 12 Drawing Sheets

FIG. 5

| | VERTICAL DISPLACEMENT AMOUNT | HORIZONTAL DISPLACEMENT AMOUNT |
|---|---|---|
| CORRECTION PARAMETER | 0.7 mm | 1.3 mm |

IMAGE FORMING SYSTEM

CROSS-REFERENCE TO RELATED APPLICATIONS

This application is based on and claims priority under 35 USC 119 from Japanese Patent Application No. 2017-247274 filed Dec. 25, 2017.

BACKGROUND

Technical Field

The present invention relates to image forming systems.

SUMMARY

According to an aspect of the invention, there is provided an image forming system including a first image forming apparatus and a second image forming apparatus. The first image forming apparatus includes an image forming unit that at least forms an image of a first color. The second image forming apparatus includes an image forming unit that forms an image of a second color different from a color of an image formed by the image forming unit of the first image forming apparatus, and also includes an image forming unit that forms an image of the first color. The first image forming apparatus and the second image forming apparatus use the first color to form positional-adjustment images for adjusting image formation positions between the first image forming apparatus and the second image forming apparatus.

BRIEF DESCRIPTION OF THE DRAWINGS

Exemplary embodiments of the present invention will be described in detail based on the following figures, wherein:

FIG. 5 illustrates a specific example of correction parameters stored in a correction-parameter storage unit;

DETAILED DESCRIPTION

An exemplary embodiment of the present invention will be described in detail below with reference to the drawings.

Figure 1:
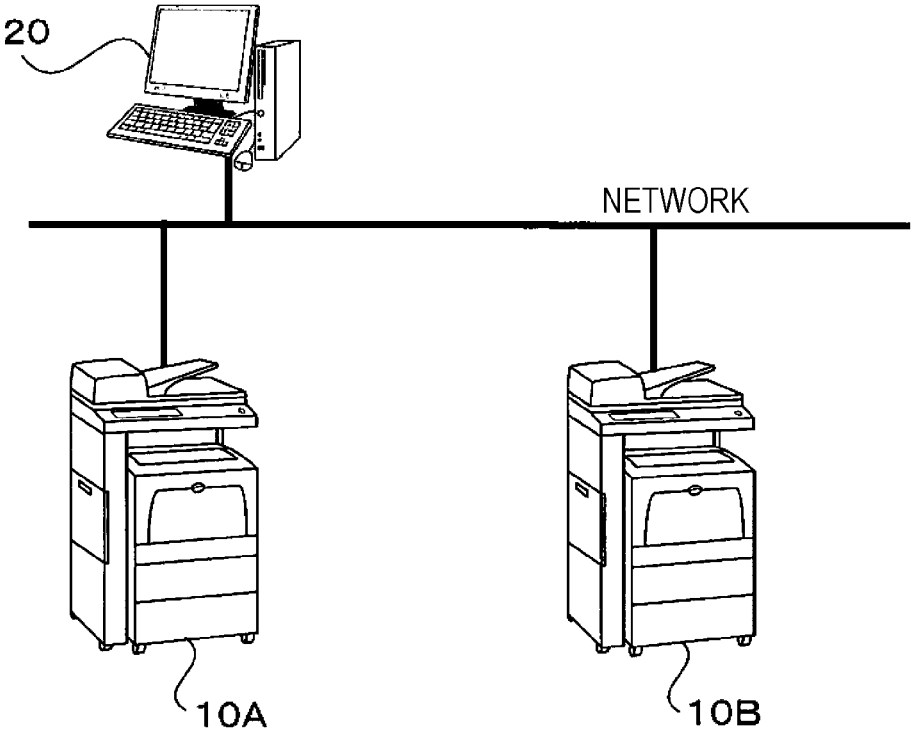
FIG. 1 illustrates a system configuration of an image forming system according to an exemplary embodiment of the present invention.

FIG. 1 illustrates a system configuration of an image forming system according to an exemplary embodiment of the present invention.

As shown in FIG. 1, a printing system according to an exemplary embodiment of the present invention includes two image forming apparatuses 10A and 10B and a terminal apparatus 20 that are connected to one another via a network.

The image forming apparatus 10B is a printer, that is, a so-called YMCK printer, capable of forming a process-color (YMCK) image constituted of yellow (Y), magenta (M), cyan (C), and black (K) colors onto a recording medium, such as a printing sheet.

The image forming apparatus 10A is a printer, that is, a so-called spot-color printer, capable of forming an image of a spot color other than the YMCK process colors onto a recording medium. A spot color includes various colors other than the YMCK colors, such as metallic luster colors, including silver (Si) and gold (G) colors, a white color (W), and a transparent color. The following description with regard to this exemplary embodiment relates to a case where the image forming apparatus 10A is capable of forming images of three types of spot colors, namely, silver (Si), gold (G), and white (W) colors.

Because a white printing sheet is used in this exemplary embodiment, colors that are not capable of ensuring a contrast ratio against a white-color background at a specific value or higher when printing is performed on a white printing sheet are expressed as spot colors. Specifically, for example, since gold toner and silver toner contain metallic foil, light radiated when reading an image is scattered and is thus not reflected at a predetermined angle, sometimes making it difficult to properly read the image. Moreover, supposing that a test image is printed by using transparent toner, the image is not properly read since the light is transmitted through the transparent color. Furthermore, supposing that a test image is printed by using white toner, the contrast against the background color is not sufficiently ensured, thus making it difficult to properly read the image. If the printing sheet has a certain color, such as black, a contrast ratio of a specific value or higher may be ensured even when a test image is printed by using white toner.

Due to the above reasons, in this exemplary embodiment in which a white printing sheet is used, colors other than the YMCK colors, such as gold, silver, transparent, and white colors, are expressed as spot colors.

Furthermore, although the YMCK colors are described as process colors and the colors other than the YMCK colors are described as spot colors in this exemplary embodiment, the classification of the process colors and the spot colors are not limited to such a case. Although the YMCK colors are classified as process colors due to having strong contrast against a white printing sheet, colors, such as light cyan, light magenta, green, violet, and orange colors, may be process colors so long as these colors are capable of achieving strong contrast against a white printing sheet. Moreover, if the printing sheet has a certain color, such as black, white color may be classified as a process color due to having strong contrast against the printing sheet.

Furthermore, the image forming apparatus 10A is configured to form a black (K) image, which is a process-color image, in addition to the images of these three types of spot colors. The reason that the image forming apparatus 10A is configured in this manner will be described later.

Accordingly, in the image forming system according to this exemplary embodiment, the image forming apparatus 10A has a function for forming a black (K) image, which is a process-color image, and spot-color images other than YMCK images. The image forming apparatus 10B has a function for forming YMCK images, which are process-color images.

In the printing system according to this exemplary embodiment, a printing sheet having an image formed thereon using one of the two image forming apparatuses 10A and 10B undergoes additional printing by printing another image thereon using the other image forming apparatus.

Figure 2:
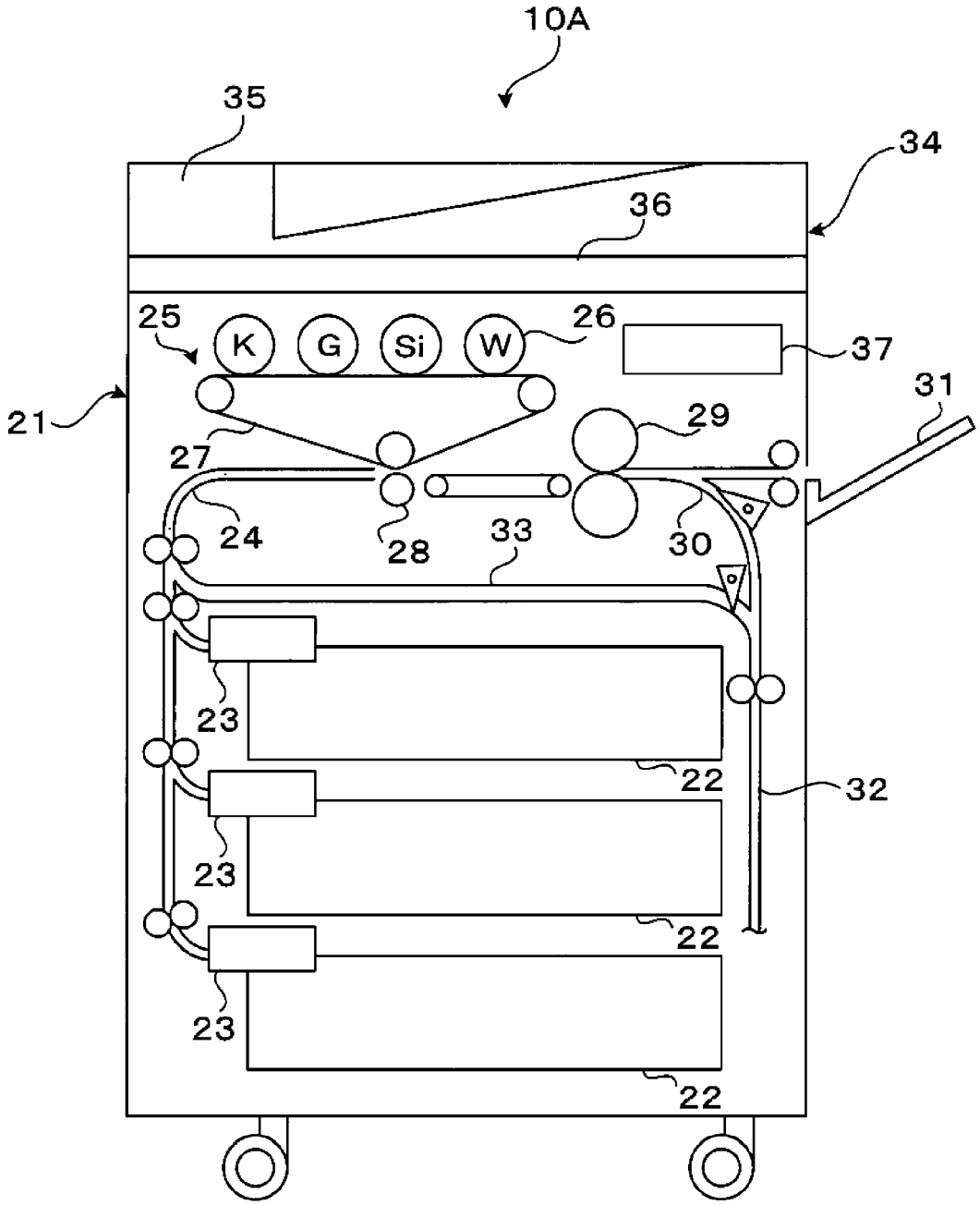
FIG. 2 is a cross-sectional view illustrating the structure of an image forming apparatus according to an exemplary embodiment of the present invention.

Next, the structure of the image forming apparatus 10A shown in FIG. 1 will be described with reference to FIG. 2. FIG. 2 is a cross-sectional view illustrating the structure of the image forming apparatus 10A according to this exemplary embodiment. The structure of the image forming apparatus 10B only differs from that of the image forming apparatus 10A in that the toners set therein are process-color toners, that is, YMCK toners, instead of spot-color toners. Therefore, a description regarding the structure of the image forming apparatus 10B will be omitted.

The image forming apparatus 10A has a printing device 21 and an image reading device 34. The printing device 21 has, for example, three recording-medium feed cassettes 22, and these recording-medium feed cassettes 22 are respectively provided with feed heads 23.

When one of the recording-medium feed cassettes 22 is selected, the feed head 23 is actuated so that a recording medium is fed from the selected recording-medium feed cassette 22 to an image forming section 25 via a recording-medium feed path 24.

The image forming section 25 is provided with white (W), silver (Si), gold (G), and black (K) photoconductors 26 arranged side-by-side, and is also provided with an intermediate transfer belt 27.

Each photoconductor 26 is surrounded by, for example, a charging device, an exposure device, a developing device, a first-transfer device, and a cleaning device (not shown), thereby constituting an image forming unit that forms an image for each color onto a recording medium. A toner image formed at each photoconductor 26 is transferred onto the intermediate transfer belt 27.

The toner images on the intermediate transfer belt 27 are transferred onto a transported recording medium by a second-transfer roller 28 and are fixed to the recording medium by a fixing device 29. The recording medium having the toner images fixed thereto is output to an output tray 31 via a recording-medium output path 30.

If duplex printing is set, the recording medium having the image fixed to the front face thereof by the fixing device 29 is transported from the recording-medium output path 30 to an inverting device 32. The recording medium is inverted by this inverting device 32, is transported to a recording-medium inverting path 33, is returned to the recording-medium feed path 24 again, and is transported to the image forming section 25 where printing is performed on the back face of the recording medium.

The image reading device 34 has an automatic document feeder 35 capable of reading both faces of a document. The document is transported to a platen 36 by the automatic document feeder 35, and an image of the document on the platen 36 is read by a reader constituted of, for example, a charge coupled device (CCD). The automatic document feeder 35 also serves as a platen cover. A document may be placed on the platen 36 by opening this platen cover. The opening and closing of the platen cover are detectable by a platen-cover open-close detector.

The image forming apparatus 10A is provided with a facsimile modem connected to a public line and a network communication device connected to a network, such as a local area network (LAN). By using the network communication device provided in the image forming apparatus 10A, an image read by the image reading device 34 is transmittable to a terminal connected to the network. By executing such a process, the image forming apparatus 10A also functions as a facsimile transmitter.

The image forming apparatus 10A is also provided with a controller 37 for controlling various components, such as the image forming section 25. The printing device 21 and the image reading device 34 perform, for example, a printing process and an image reading process based on control by the controller 37.

In a case where a YMCK image and a spot-color image are to be printed in an overlapping manner on a single printing sheet, the image forming apparatuses 10A and 10B perform additional printing on the single printing sheet. Specifically, a printing process is performed such that the image forming apparatus 10A first forms a spot-color image on the printing sheet, and the image forming apparatus 10B subsequently forms a YMCK image on the printing sheet having the spot-color image printed thereon.

In this case, if misregistration occurs between the print position (image formation position) of the image printed by the image forming apparatus 10A and the print position of the image printed by the image forming apparatus 10B, a defect may occur in the resultant image. Therefore, it is necessary to perform positional correction that minimizes such misregistration in the print positions between the image forming apparatus 10A and the image forming apparatus 10B.

In order to perform such print-position correction, the image forming apparatus 10A and the image forming apparatus 10B generate a test chart by forming test images (positional-adjustment images) on a single printing sheet and perform print-position correction based on the test chart. An example of the test images, an example of the test chart used for adjusting the print positions between the image forming apparatuses 10A and 10B, and a specific method for adjusting the print positions based on the generated test chart will be described later.

The image forming apparatus 10A and the image forming apparatus 10B form test images for adjusting the print positions between the image forming apparatuses 10A and 10B by using black (K), which is one of the YMCK process colors.

Although the image forming apparatus 10A is described as using black (K) as a process color when forming a test image in this exemplary embodiment, the image forming apparatus 10A may alternatively use any one of the YMCK colors as a process color so long as the color has strong contrast against a white printing sheet.

Figure 3:
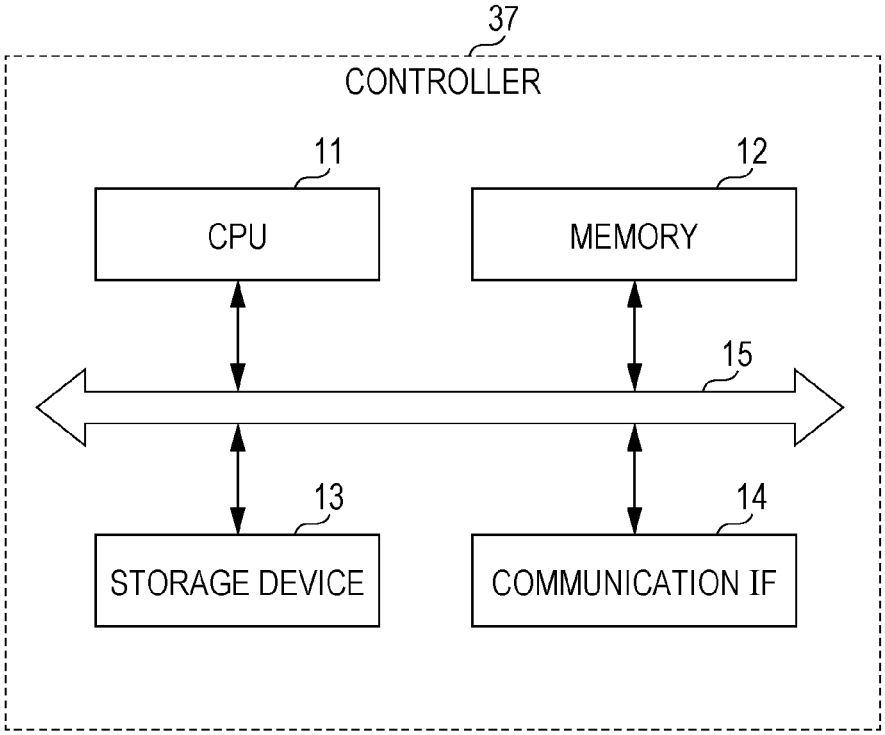
FIG. 3 illustrates a hardware configuration of a controller shown in FIG. 2.

FIG. 3 illustrates a hardware configuration of the controller 37.

As shown in FIG. 3, the controller 37 includes a central processing unit (CPU) 11, a memory 12, a storage device 13, such as a hard disk drive, and a communication interface (IF) 14 that transmits and receives data to and from an external apparatus via a network. These components are connected to one another via a control bus 15.

The CPU 11 executes a predetermined process based on a control program stored in the memory 12 or the storage device 13 so as to control the operation of the controller 37. Although the CPU 11 in this exemplary embodiment is configured to read and execute the control program stored in the memory 12 or the storage device 13, the program may be provided to the CPU 11 by being stored in a storage medium, such as a compact disc read-only memory (CD-ROM).

Figure 4:
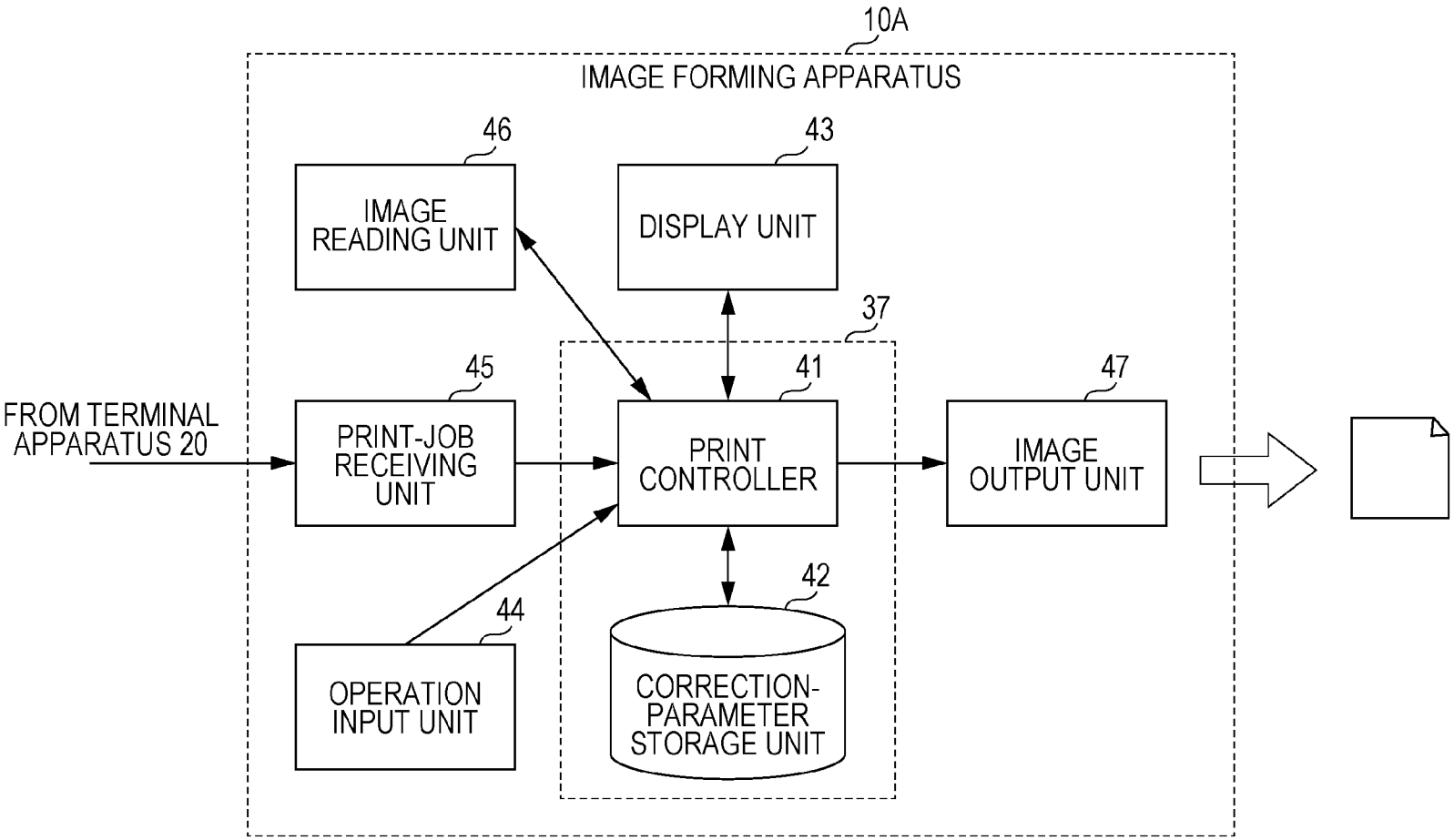
FIG. 4 is a block diagram illustrating a functional configuration of the entire image forming apparatus including the controller.

FIG. 4 is a block diagram illustrating a functional configuration of the entire image foisting apparatus 10A including the controller 37 realized by executing the aforementioned control program.

As shown in FIG. 4, the image forming apparatus 10A according to this exemplary embodiment includes the controller 37, a display unit 43, an operation input unit 44, a print-job receiving unit 45, an image reading unit 46, and an image output unit 47. The controller 37 includes a print controller 41 and a correction-parameter storage unit 42.

The print-job receiving unit 45 receives a print job (i.e., a print command) transmitted from the terminal apparatus 20.

The print controller 41 generates print data based on the print job received by the print-job receiving unit 45 and performs control for outputting the generated print data from the image output unit 47.

The display unit 43 is controlled by the controller 37 and displays various types of information to a user. The operation input unit 44 receives various types of operation information input by the user. The display unit 43 and the operation input unit 44 constitute a so-called operation panel.

Based on control by the print controller 41, the image output unit 47 outputs an image onto a recording medium, such as a printing sheet, having undergone various processes, such as charging, exposure, developing, transfer, and fixing processes.

When the image is to be formed on the recording medium at the image output unit 47, the correction-parameter storage unit 42 stores correction parameters (correction information) for correcting the image formation position, that is, the print position.

FIG. 5 illustrates a specific example of the correction parameters stored in the correction-parameter storage unit 42. In the image forming apparatus 10A according to this exemplary embodiment, the correction-parameter storage unit 42 stores two pieces of correction information, namely, correction parameters 1 and 2.

In order to simplify the description in this exemplary embodiment, the correction parameters include two types of correction amounts, namely, a "vertical displacement amount" and a "horizontal displacement amount", as shown in FIG. 5. However, since actual print-position misregistration includes multiple misregistration components caused by various displacement amounts, the correction parameters may also include various correction amounts, such as a trapezoidal distortion amount, a vertical-parallelogram distortion amount, a horizontal-parallelogram distortion amount, vertical magnification, and horizontal magnification, in addition to the above correction amounts.

The print controller 41 corrects the image formation position of the image to be formed by the image forming units in the image output unit 47 in accordance with the correction parameters stored in the correction-parameter storage unit 42.

The image reading unit 46 is an image reader that reads an image of a placed document and functions as a detector that detects the print position of an image printed on a printing sheet.

The print controller 41 corrects the print positions of process-color and spot-color images to be formed by the image forming apparatus 10A based on the positional relationship between a test image of the image forming apparatus 10A and a test image of the image forming apparatus 10B on the printing sheet (i.e., test chart) read by the image reading unit 46. In a case where the print position correction is to be performed in the image forming apparatus 10B, the print position of a process-color image to be formed by the image forming apparatus 10B is corrected based on the positional relationship between the test image of the image forming apparatus 10A and the test image of the image forming apparatus 10B on the printing sheet.

Next, a specific example of a case where additional printing is performed by the image forming apparatuses 10A and 10B will be described with reference to FIGS. 6 and 7.

Figure 6:
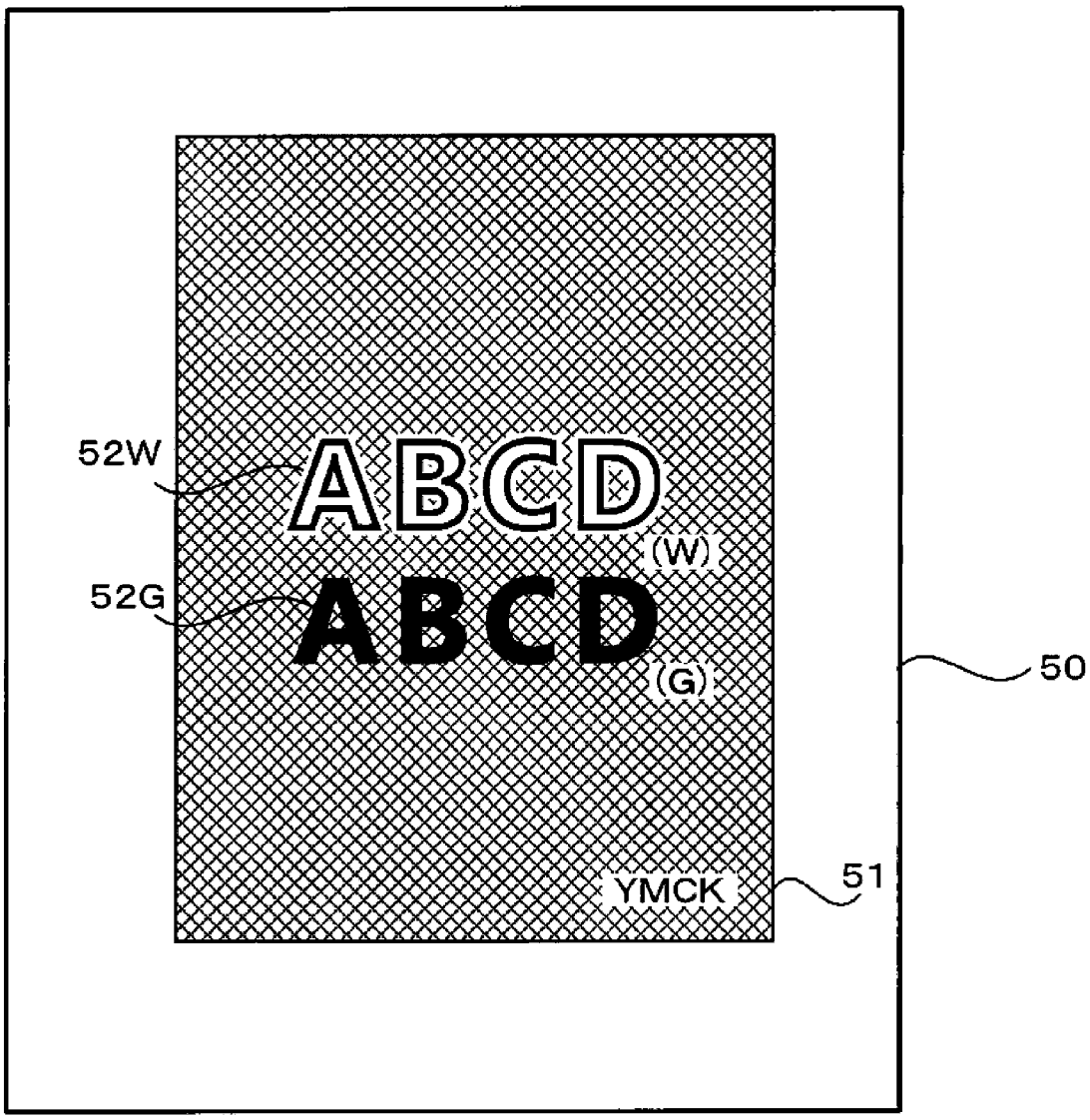
FIG. 6 illustrates an example of a print result in a case where additional printing is performed by first and second image forming apparatuses.
Figure 7:
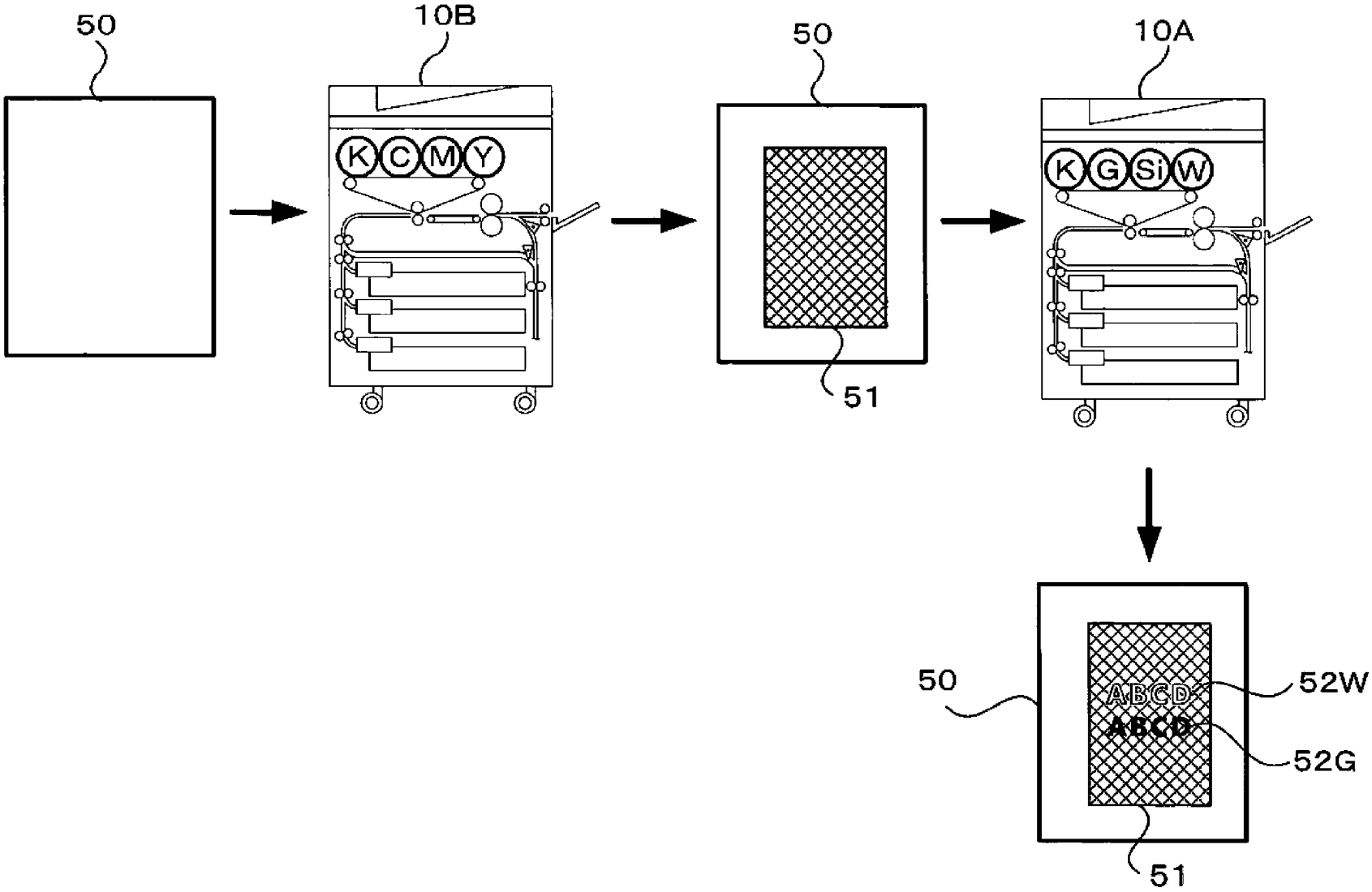
FIG. 7 illustrates a printing sequence in a case where a printing process is performed twice using the first and second image forming apparatus for obtaining the print result shown in FIG. 6.

The following description relates to a case where a printing process for obtaining a print result as shown in FIG. 6 is executed.

In the example of the print result shown in FIG. 6, a YMCK image 51 is formed on a white printing sheet 50, and a white (W) text image 52W and a gold (G) text image 52G are formed on the YMCK image 51.

In order to obtain the print result shown in FIG. 6, the printing process has to be performed twice by using the image forming apparatuses 10A and 10B. The printing sequence of this printing process will be described with reference to FIG. 7.

First, the image forming apparatus 10B as a YMCK printer forms the YMCK image 51 on the printing sheet 50.

Subsequently, the image forming apparatus 10A as a spot-color printer forms the white (W) and gold (G) text images 52W and 52G on the printing sheet 50 having the YMCK image 51 formed thereon.

Because a printing sheet contains moisture, the printing sheet passing through the fixing device undergoes a slight change in sheet size due to the moisture partially evaporating in accordance with heat. When an image is formed on the printing sheet in a certain image forming apparatus and another image is to be formed again on the printing sheet in another image forming apparatus, the print positions may sometimes deviate from each other due to other various factors. Therefore, in a case where images are to be formed on the same printing sheet 50 by using the two above-described image forming apparatuses 10A and 10B, the image formation positions have to be adjusted.

Thus, correction parameters for correcting the print position for the YMCK image 51 to be formed by the image forming apparatus 10B and the print positions for the white and gold text images 52W and 52G to be formed by the image forming apparatus 10A are generated and are stored in the correction-parameter storage unit 42.

Next, a method for generating these correction parameters will be described.

The correction parameters are generated by using a test chart obtained by causing the image forming apparatus 10B to form a first test image (i.e., a print-position adjustment image) on the printing sheet and subsequently causing the image forming apparatus 10A to form a second test image on the printing sheet.

The correction parameters are generated by the print controller 41 in the controller 37 and are stored in the correction-parameter storage unit 42. Specifically, the print controller 41 generates the correction parameters based on the positional relationship between the first test image and the second test image on the test chart.

Next, a specific method for generating the correction parameters from the test chart will be described with reference to FIGS. 8A to 10.

Figure 8A:
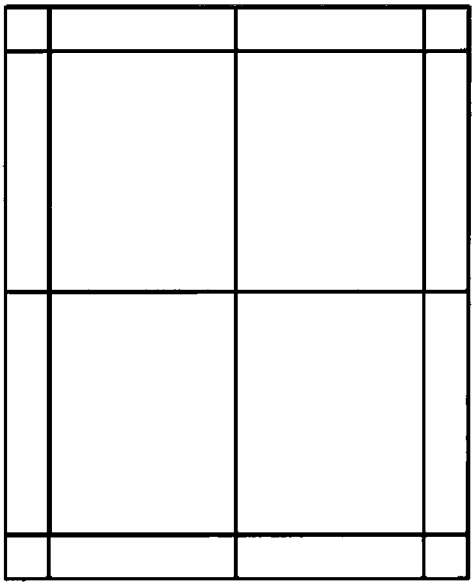
FIG. 8A illustrates an example of a test image printed in the first image forming apparatus.
Figure 8B:
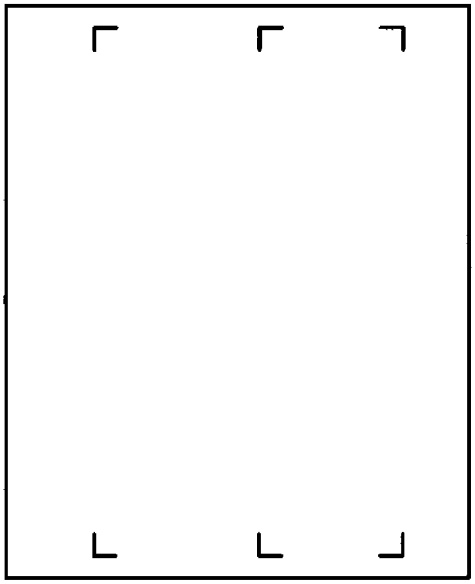
FIG. 8B illustrates an example of a test image printed in the second image forming apparatus.

FIG. 8A illustrates an example of a test image printed in the image forming apparatus 10A, and FIG. 8B illustrates an example of a test image printed in the image forming apparatus 10B. These test images may be stored in the image forming apparatuses 10A and 10B before they are printed, or the terminal apparatus 20 may command the image forming apparatuses 10A and 10B to print these test images.

Figure 9:
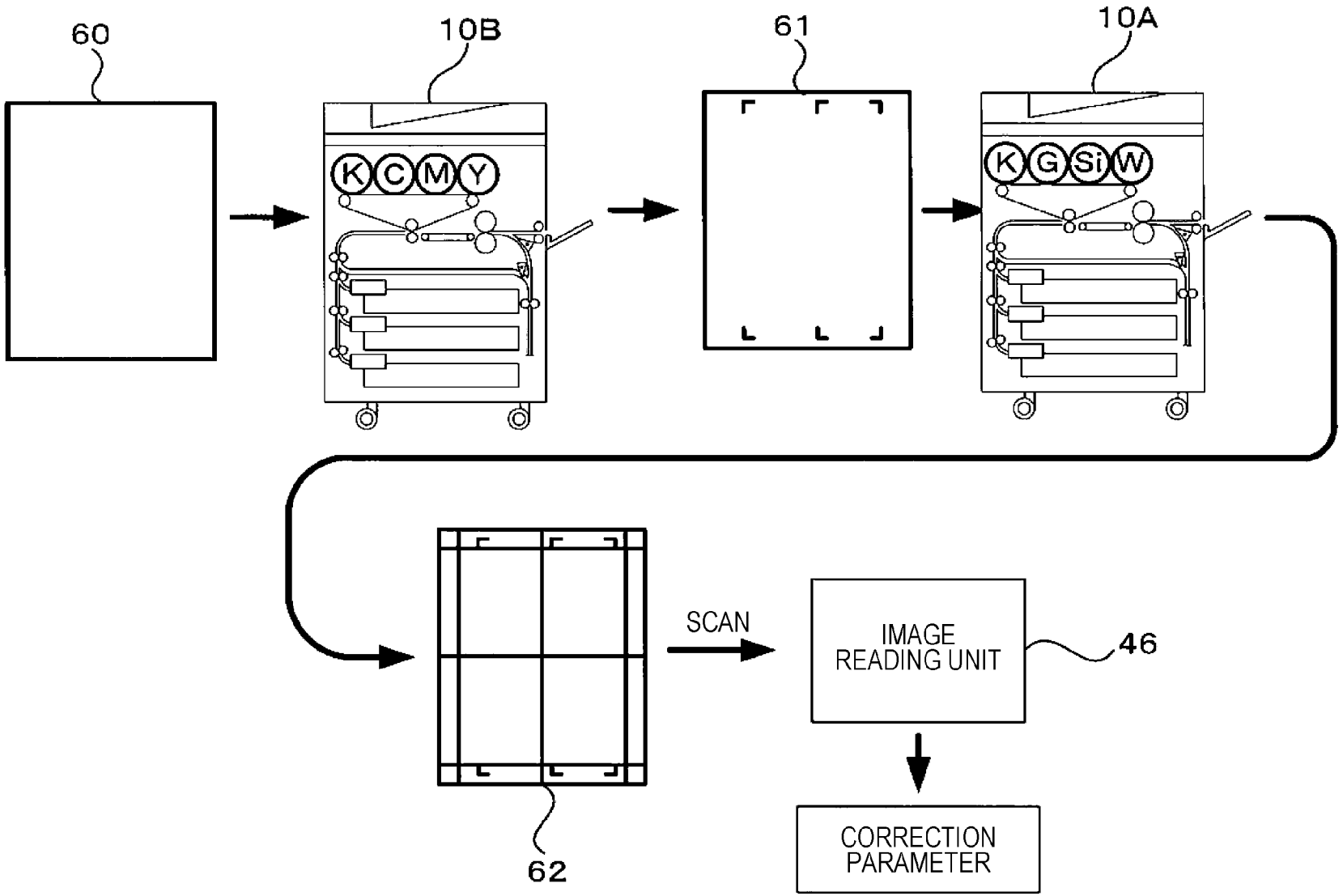
FIG. 9 illustrates a correction-parameter generating method.

A test-chart generating method for generating a correction parameter will now be described with reference to FIG. 9.

First, the image forming apparatus 10B prints a test image, as shown in FIG. 8B, onto a printing sheet 60 having no images printed thereon.

Then, the image forming apparatus 10A prints a test image, as shown in FIG. 8A, onto a printing sheet 61 having the aforementioned test image printed thereon.

A test chart 62 having these two test images printed thereon is read (scanned) by the image reading unit 46 of the image forming apparatus 10A, whereby a correction parameter is generated.

A specific method for generating a correction parameter from such a test chart 62 will now be described with reference to FIG. 10.

Figure 10:
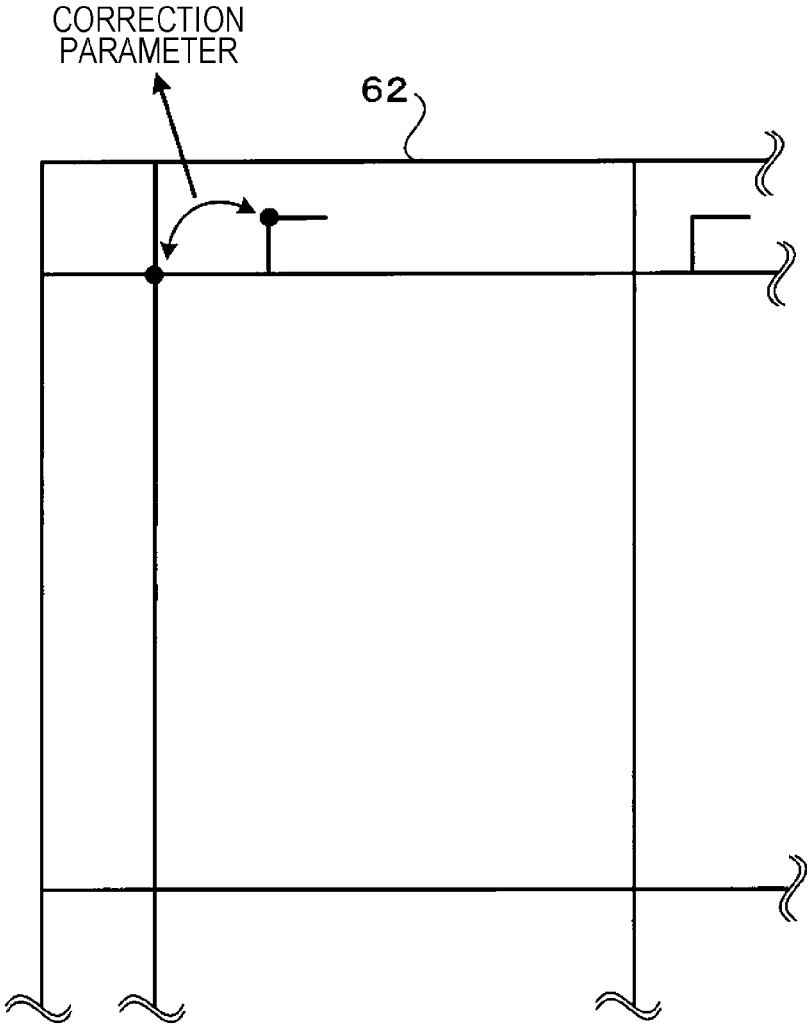
FIG. 10 illustrates a specific method for generating a correction parameter from a test chart.

The print controller 41 of the image forming apparatus 10A extracts the positional relationship between the two test images, as shown in FIG. 10, from the image of the test chart read by the image reading unit 46 and generates a correction parameter based on the extracted positional relationship. Specifically, if the positional relationship between a certain position of the test image generated by the image forming apparatus 10A and a certain position of the test image generated by the image forming apparatus 10B is known in advance, a correction parameter that allows for a proper positional relationship between two actually-printed images may be generated by detecting a deviation in the positional relationship between actually-read test images. Although FIG. 10 relates to a case where a single position in one of the two test images and a single position in the other test image are compared, a correction parameter in actuality is generated by comparing multiple positions in a test chart.

Then, the print controller 41 generates a correction parameter from the test chart 62 and causes the correction-parameter storage unit 42 to store the correction parameter.

Figure 11:
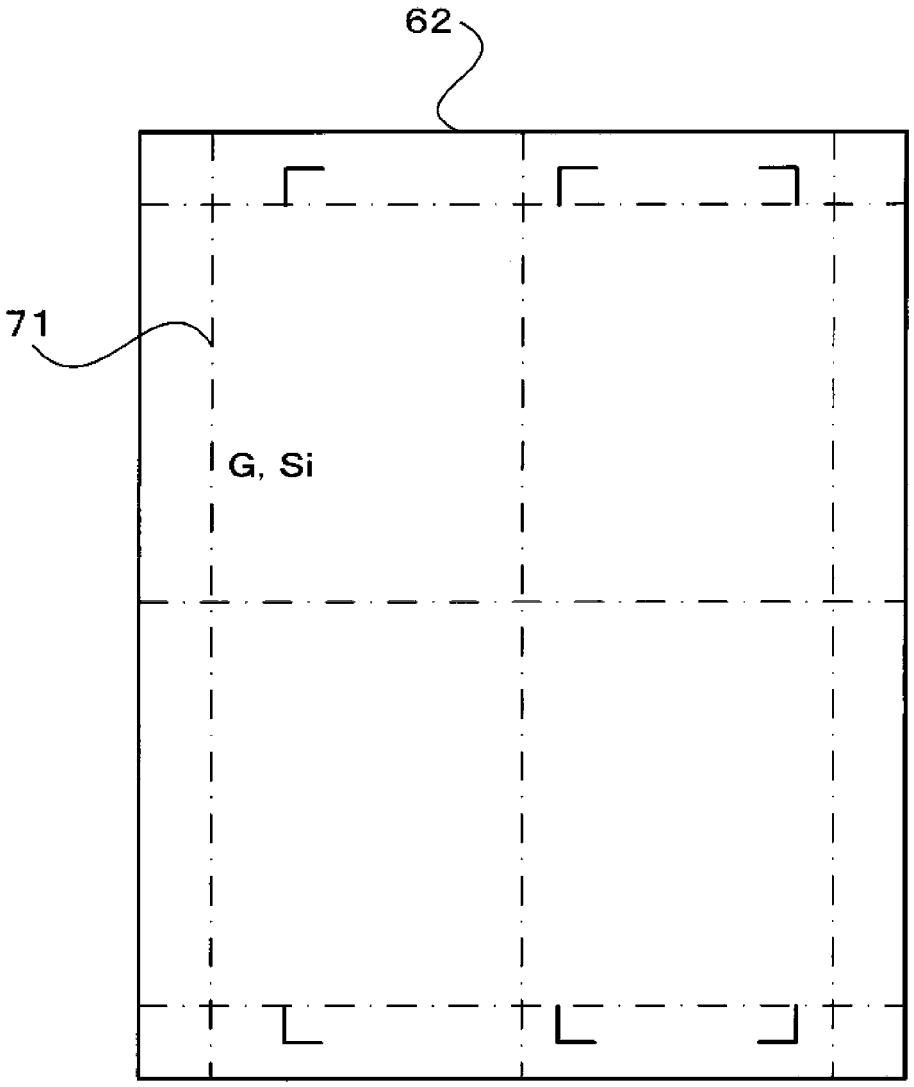
FIG. 11 illustrates an example of a test chart in a case where a test image is printed by using colors other than black, such as gold and silver colors.

FIG. 11 illustrates an example of a test chart in a case where a test image is printed by using colors other than black (K), such as gold and silver colors, when the test image is printed onto a printing sheet in the image forming apparatus 10A.

In the example of the test chart shown in FIG. 11, sufficient contrast against a white printing sheet is not ensured because a test image 71 printed by the image forming apparatus 10A has gold or silver color.

Even if the test chart shown in FIG. 11 is read by the image reading unit 46 of the image forming apparatus 10A, the print position of the test image 71 is not properly detectable, possibly making it difficult to generate a proper correction parameter.

Thus, in the image forming system according to this exemplary embodiment, when a test image is to be formed in the image forming apparatus 10A, printing is performed by using black (K), which is a process color, instead of spot colors, such as gold and silver colors. Likewise, in the image forming apparatus 10B, printing is performed by using black (K) when forming a test image.

Specifically, the image forming apparatus 10A is provided with the image reading unit 46 as a detector that detects the print position of an image printed on a printing sheet, and prints a test image by using black (K), which is a color from which the contrast from white color, which is the color of the printing sheet, is determinable by the image reading unit 46.

Although the image reading unit 46 in the image forming apparatus 10A is used as a detector in this exemplary embodiment, either one of the image forming apparatuses 10A and 10B may be provided with such a detector.

Furthermore, in the image forming apparatus 10A and the image forming apparatus 10B, it is more desirable that the image forming units for printing the test images be provided at identical positions or corresponding positions to achieve higher accuracy for positional correction.

Figure 12:
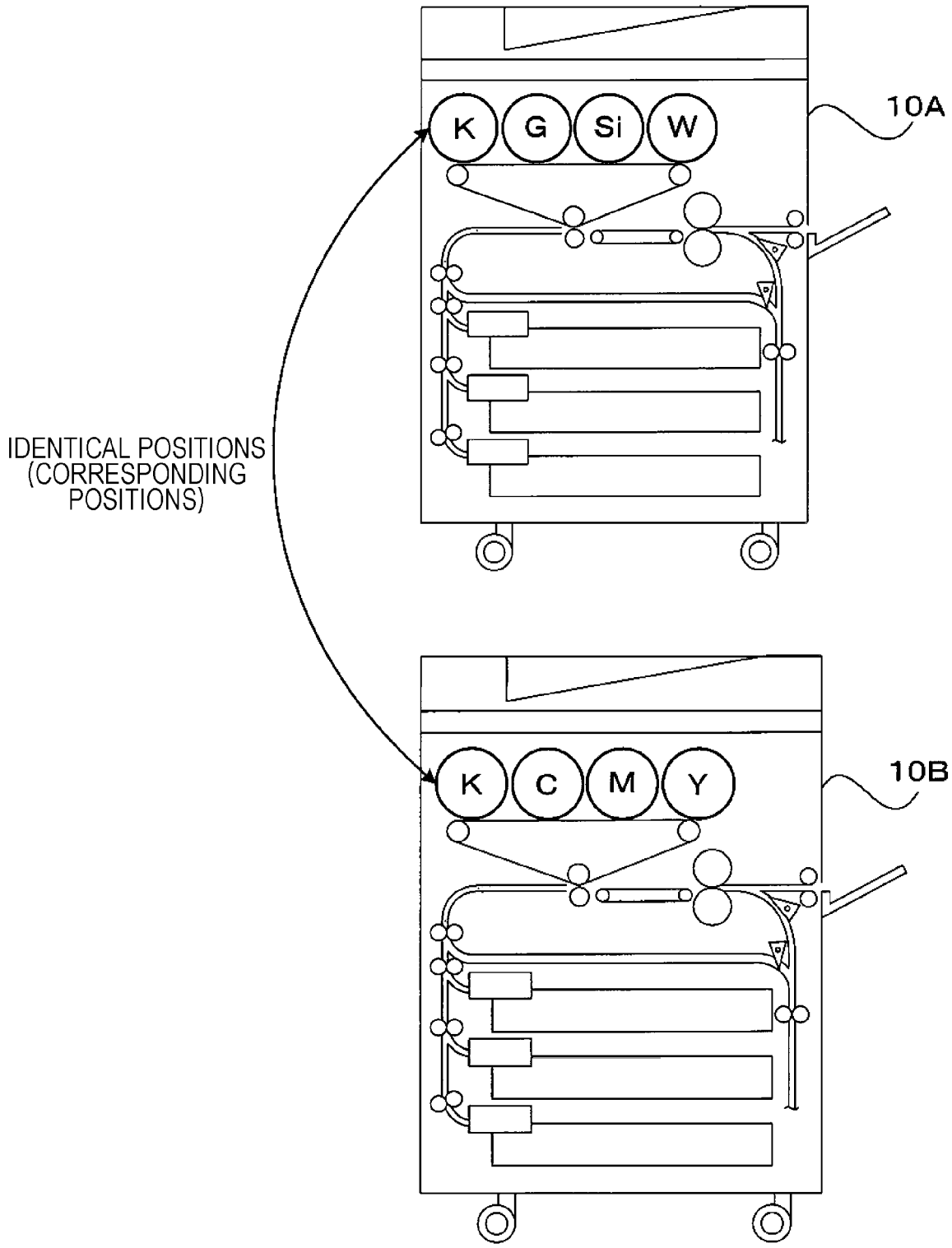
FIG. 12 illustrates a case where black-image forming units for printing test images are located at identical positions in the first and second image forming apparatuses.

Specifically, as shown in FIG. 12, each of the image forming apparatuses 10A and 10B has multiple image forming units for sequentially forming images on a printing sheet. In each of the image forming apparatuses 10A and 10B, at least one of the multiple image forming units is a black (K) image forming unit. When sequentially forming multiple color images onto a printing sheet, the sequence in which a black (K) image is formed is the same between the image forming apparatus 10A and the image forming apparatus 10B.

If there are multiple black (K) image forming units in either one of the image forming apparatus 10A and the image forming apparatus 10B, the image forming apparatus 10A and the image forming apparatus 10B may print test images using the image forming units set at the corresponding positions.

MODIFICATIONS

As an alternative to the above exemplary embodiment in which a printing process is sequentially performed on the same printing sheet by first using the image forming apparatus 10B serving as a YMCK printer and then using the image forming apparatus 10A serving as a spot-color printer, the exemplary embodiment of the present invention may be similarly applied to a case where a printing process is sequentially performed on the same printing sheet by first using the image forming apparatus 10A serving as a spot-color printer and then using the image forming apparatus 10B serving as a YMCK printer.

Furthermore, as alternative to the above exemplary embodiment in which the print-position correction is performed by storing the correction parameters in the image forming apparatus 10A, the print-position correction may be performed by storing the correction parameters in the image forming apparatus 10B.

Moreover, as an alternative to the above exemplary embodiment in which test images are formed by using black (K), which is a process color, in the image forming apparatuses 10A and 10B, the exemplary embodiment of the present invention is similarly applicable so long as the image forming apparatus 10A includes an image forming unit that at least forms an image of a first color, and the image forming apparatus 10B includes an image forming unit that forms an image of a second color different from a color of an image formed by an image forming unit of the image forming apparatus 10A, as well as an image forming unit that forms an image of the first color.

Furthermore, as an alternative to the above exemplary embodiment of the present invention that is applied to image forming apparatuses that form images onto recording media, such as printing sheets, by using electrophotography, the exemplary embodiment of the present invention is similarly applicable to image forming apparatuses that form images by other methods, such as the inkjet method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

a first image forming apparatus including an image forming unit that at least forms an image of a first color; and a second image forming apparatus including an image forming unit that forms an image of a second color different from a color of an image formed by the image forming unit of the first image forming apparatus and also including an image forming unit that forms an image of the first color, wherein the image of the first color and the image of the second color have different contrast ratios with respect to a printing sheet desired to be printed with the images of the first color and the second color, wherein the first image forming apparatus and the second image forming apparatus use the first color to form positional-adjustment images on the printing sheet for adjusting image formation positions between the first image forming apparatus and the second image forming apparatus.

2. An image forming system comprising:

a first image forming apparatus that forms an image of a process color; and a second image forming apparatus that forms an image of the process color and a spot color, wherein the first image forming apparatus and the second image forming apparatus use the process color to form positional-adjustment images for adjusting image formation positions between the first image forming apparatus and the second image forming apparatus.

3. The image forming system according to claim 2, wherein the process color is any one of yellow, magenta, cyan, and black colors.

4. The image forming system according to claim 3, wherein the process color is black.

5. The image forming system according to claim 2, wherein each of the first image forming apparatus and the second image forming apparatus has a plurality of image forming units that sequentially form images onto a recording medium, and at least one of the plurality of image forming units in each of the first image forming apparatus and the second image forming apparatus is an image forming unit for the process color, and wherein, when images of a plurality of colors are to be sequentially formed on the recording medium, a sequence in which the image of the process color is formed is identical in the first image forming apparatus and the second image forming apparatus.

6. The image forming system according to claim 2, wherein one of the first image forming apparatus and the second image forming apparatus includes a detector that detects a position of an image formed on a recording medium, and wherein the process color is a color from which contrast from a color of the recording medium is determinable by the detector.

7. The image forming system according to claim 6, wherein the detector is an image reader that reads an image of a placed document, and wherein the image forming system further comprises a correcting unit that corrects a position of the image of the process color formed by the first image forming apparatus or a position of the image of the process color and the spot color formed by the second image forming apparatus based on a positional relationship between the positional-adjustment image of the first image forming apparatus and the positional-adjustment image of the second image forming apparatus on the recording medium read by the image reader.

8. The image forming system according to claim 2, wherein each of the first image forming apparatus and the second image forming apparatus has a plurality of image forming units that sequentially form images onto a recording medium, and at least one of the plurality of image forming units in each of the first image forming apparatus and the second image forming apparatus is an image forming unit for the process color, and wherein, in a case where one of the first image forming apparatus and the second image forming apparatus has a plurality of image forming units for process colors, the first image forming apparatus and the second image forming apparatus form the positional-adjustment images by using the image forming units set at corresponding positions.

9. An image forming system comprising:

first image forming means including image forming means that at least forms an image of a first color; and second image forming means including image forming means that forms an image of a second color different from a color of an image formed by the image forming means of the first image forming means and also including image forming means that forms an image of the first color, wherein the image of the first color and the image of the second color have different contrast ratios with respect to a printing sheet desired to be printed with the images of the first color and the second color, wherein the first image forming means and the second image forming means use the first color to form positional-adjustment images on the printing sheet for adjusting image formation positions between the first image forming means and the second image forming means.

* * * * *